US005758395A

United States Patent [19]

Lenzen et al.

[11] Patent Number: 5,758,395

[45] Date of Patent: Jun. 2, 1998

[54] CONTROLLING FEED IN A THREAD WARPING PROCESS AND MACHINE

[75] Inventors: Josef Lenzen, Dulmen; Herbert Wisniewski, Coesfeld-Lette; Josef Heuermann, Billerbeck, all of Germany

[73] Assignee: Karl Mayer Textilmaschinenfabrik GmbH, Germany

[21] Appl. No.: 537,933

[22] PCT Filed: Mar. 16, 1994

[86] PCT No.: PCT/EP94/00826

§ 371 Date: Oct. 17, 1996

§ 102(e) Date: Oct. 17, 1996

[87] PCT Pub. No.: WO94/25652

PCT Pub. Date: Nov. 10, 1994

[30] Foreign Application Priority Data

Apr. 30, 1993 [DE] Germany ..... 43 14 393.8

[51] Int. Cl.[6] ..... D02H 3/00

[52] U.S. Cl. ..... 28/191; 28/195

[58] Field of Search ..... 28/191, 195

[56] References Cited

U.S. PATENT DOCUMENTS

| | | | |
|---|---|---|---|
| 4,974,301 | 12/1990 | Beerli et al. | 28/191 |
| 5,107,574 | 4/1992 | Beerli et al. | 28/191 |
| 5,410,786 | 5/1995 | Bogucki-land | 28/191 |

FOREIGN PATENT DOCUMENTS

| | | | |
|---|---|---|---|
| 0 423 067 | 9/1990 | European Pat. Off. | 28/190 |
| 0531737 | 8/1992 | European Pat. Off. . | |
| 3219132 | 1/1983 | Germany . | |
| 3432276 | 4/1985 | Germany | 28/190 |
| 37 02 293 | 9/1987 | Germany | 28/190 |
| 9110393 | 11/1991 | Germany . | |
| 40 07 620 | 12/1991 | Germany | 28/190 |
| 91 12 257 | 1/1992 | Germany | 28/190 |
| 4304956 | 8/1994 | Germany . | |

*Primary Examiner*—Andy Falik
*Attorney, Agent, or Firm*—Omri M. Behr

[57] ABSTRACT

In a warping machine, once a temporary feed speed for a warping reed is set in synchronism with the speed of rotation of the warping drum, the winding thickness of the warp lap is detected several times and the feed speed is corrected depending on the number of revolutions of the warping drum and the winding thickness that results therefrom. The winding of the warp lap is then completed at the corrected feed speed. During a starting phase, a theoretically correct feed speed for at least the first revolution of the warping drum is derived from warp parameters, such as the total number of threads, the width of the warp and the yarn count. The winding thickness of the first warp section is continuously and contactlessly measured during a learning phase that follows the starting phase, or during the starting phase. For that purpose, a winding thickness measurement arrangement is held at a predetermined, substantially constant distance from the surface of the warp layer that has just been wound. The winding thickness is determined from the signals produced by the winding thickness measurement arrangement and the feed speed is regulated on the basis of the winding thickness on the second revolution of the warping drum at the earliest, from after the learning phase is finished. The regulated feed speed is stabilized in a working phase and a constant feed speed for the rest of the warping process is determined from the latest data obtained.

18 Claims, 4 Drawing Sheets

CONTROLLING FEED IN A THREAD WARPING PROCESS AND MACHINE

BACKGROUND OF THE INVENTION

1. Field of the Invention

The invention is directed to a process and machine for warping threads on a warp drum by setting a preliminary feed speed for a warping reed and then plurally scanning the applied thickness of a warping wind to determine a corrected feed speed to be used thereafter, which feed speed depends upon the rotation of the warp drum and the thickness of the applied warping wind.

2. Description of Related Art

A process for warping threads onto a warping drum of a warping machine is disclosed in DE OS 3 702 293. In this process a warping reed is displaced relative to the warping drum in dependence upon the growing wind thickness. During the warping of the first band with predetermined warp thread feed, the wind diameter is measured by a tapping means during the at rest position of the warping drum. Furthermore, its adjusting path is measured during a winding measurement phase in dependence upon the number of revolutions of the warping drum. Thereafter, during the warping of the rest of the first warping band, and after the copying of the measuring wind during the warping of the following bands, the feed of the warp sled during the warping of the rest of the succeeding bands is corrected in accordance with the measured adjusting path.

Thereafter, during the warping of the first band before the warping of the measuring wind, a basis wind is warped with a predetermined warping sled feed and its winding diameter determined by a tapping means, whose adjusting path is measured in dependence upon the number of revolutions. Thereafter, the tapping means is adjusted in accordance with the measured adjusting path during the warping of the basis wind, and a predetermined corrected feed for the warping of the rest of the first band is determined from the difference between the measured adjusting path of the measuring wind and the measured adjusting path of the basis wind. All further warp bands like the first band are warped with reference to the basis and measured winds with the predetermined feed, and the remaining winds are warped with the corrected warp sled feed.

The disadvantage of the known process is that a stepped wind is formed as a result of the three part build up of the first warp band. There is a further disadvantage in that while the corrected feed value is already known, in the following winds, that is to say also with basis and measuring winds, one must wind with the originally prescribed warp sled feed in order to obtain the same buildup of all the subsequent warp bands.

German Patent DE 40 07 620 C2 discloses that the thickness of the applied windings may be determined by a laser beam distance measuring means, which is directed onto a pressure contact plate pressed onto the surface of the wind buildup.

Accordingly, there is a need for a process of warping threads on a warping drum in which a stepwise wind accumulation is avoided and wherein sequential warp bands can be wound with a singularly determined corrected warping reed feed.

SUMMARY OF THE INVENTION

In accordance with the illustrative embodiments demonstrating features and advantages of the present invention, there is provided a process for warping threads into a warp wind on a warping drum of a warping machine with a warping reed and an applied thickness measuring arrangement. The process includes the step of setting a preliminary feed speed for the warping reed, synchronized with the number of rotations of the warping drum. Another step is plurally scanning for applied thickness of the warp wind. The process also includes the step of setting a corrected feed speed for winding to completion, in dependence upon (i) the number of rotations of the warping drum, and (ii) the applied thickness obtained by the step of plurally scanning. The step of setting the corrected feed speed is performed by four steps. One of the steps is determining for a starting phase, a theoretically correct feed speed, as an initial value to be used within a first rotation of the warping drum. The theoretically correct feed speed is set in accordance with one or more of a plurality of warp parameters, including total number of threads, warp width, and yarn number. Another one of the four steps is continually measuring in a contactless manner, the applied thickness of a first warp band in a learning phase occurring at least as early as completion of the starting phase, while the applied thickness measuring arrangement is held substantially at a predetermined constant separation from a just applied surface of the warp wind. A third one of the four steps is determining the applied thickness, in dependence upon signals from the applied thickness measuring arrangement, and controlling the feed speed in response to a control signal, in accordance with the applied thickness, at least as early as the second rotation of the warping drum. Another of the four steps is establishing, in a working phase following the learning phase, a constant feed speed that is to be used to completion, after stabilization of recent values of the control signal used for regulating feed speed.

According to another aspect of the present invention, a warping machine can transfer a plurality of warp bands. The machine has a warping drum and a warping reed mounted on a warping sled. The warping drum is adapted to receive the plurality of warp bands. The warping sled is positioned alongside the warping drum and is vertically movable over the warp bands applied on the warping drum. The machine also has a control means, a detecting means and an applied thickness measuring arrangement. This applied thickness measuring arrangement can provide an applied signal, signifying applied thickness on the warping drum. The detecting means can provide a revolution number signal signifying revolutions of the warp drum numerically. The control means can provide, in dependence upon the applied signal and the revolution number signal, a feed signal to signify position of the warping reed. The applied thickness measuring arrangement is movable both parallel and transversely to the warping drum synchronously with (a) revolution of the warp drum, and (b) layer change of the warp band. The applied thickness measuring means is positionable to maintain a substantially constant predetermined distance from the warp upper surface.

A preferred embodiment on the present invention can advantageously provide, that from the beginning, the warping runs totally automatically without the loss of materials. For this purpose, at the beginning of the warping process, there is provided a starting and a learning phase. In the starting phase the initial value for the feed speed is determined in dependence upon the warp parameters, that is, the total thread number, the warp breadth, and the yarn number. This temporary, theoretically determined feed speed value is utilized at least for the first rotation of the drum as the feed speed signal. The learning phase begins either with the start phase, or immediately subsequent to the start phase.

During the learning phase, in a continuous but non-contacting manner, the applied thickness of the warping band is measured by a charge thickness measuring arrangement, which is held in a predetermined substantially constant distance from the surface of the just applied warp band. The substantially constant distance from the surface of the thread sheet is advantageous in order to maintain the applied thickness measuring arrangement at its optimal measuring distance from the warp surface so as to provide a first exceedingly accurate distance measurement.

From the signals of the applied thickness measuring arrangement, one can determine the applied thickness and, in dependence upon the applied thickness, the feed speed can be controlled at least as early as the second revolution of the warping drum.

The length of the learning phase is dependent upon the stabilization of the control generated, feed speed signals. This stabilization occurs in dependence upon the yarn quality, after a different number of revolutions. This stabilization could occur, for example, after 30 revolutions. Thus, when a certain stabilization of the control has occurred, a predetermined number of just-obtained feed speed signals are collected in order to settle upon a valid constant feed speed signal for the working phase of the warping process. The entire rest of the warping process is carried out at the feed speed determined in this learning phase.

At the beginning of the working phase, one may limit the maximum correction of the feed speed signal per measuring cycle of the applied thickness measuring arrangement. In this manner, excessive variations of the control can be avoided. The correction of the feed speed signals can therefore follow in a plurality of steps in the same direction, thereby avoiding large overswings of the feed speed signals across the correct feed speed signal.

Preferably, there may be provided a laser beam distance measuring arrangement as the applied thickness measuring arrangement. For optimal control there is utilized a measuring apparatus which requires a high level of resolution of the measuring value. The contactless distance measuring with laser enables a resolution of about 30 microns.

It can advantageously be provided that the constant feed thread speed signal in the working phase is set as the average of a predetermined number of feed speed signals obtained from the measuring cycles of the learning phase, when a similarly predetermined maximum swing amplitude of the regulated feed speed signals in the learning phase is not exceeded. Switching over from the learning phase into the working phase occurs then when the standard deviation, for example of the last ten or twenty feed speed signals fall below a predetermined maximum limit.

It is provided that the constant feed speed signal is fed back to the control means at the beginning of working phase in order to determine the required wind count for maintaining the warp length set for the warping machine, and to provide to the motor control an exact count signal for the actual warping process, which guarantees the achievement of the exact warp length. It is of course possible, if necessary, to correct a preinserted wind count. At the same time, the control may give forth a warning signal if the capacity is exceeded. If the required applied winding height is exceeded an automatic cut-off of the warping machine may be instituted.

The applied thickness measuring arrangement may suitably move synchronously with the rotation of the warping drum and the change of the layering of the warp band. Under these circumstances the distance measuring is suitably directed to the middle of the warp band.

The arrangement of the present invention is characterized thereby that the applied thickness measuring arrangement is moveable both parallel to the warp drum axis, as well as orthogonal thereto, synchronously with the warp drum rotation and the layering change of the warp band, wherein the applied thickness measuring arrangement is maintained at a substantially constant predetermined distance from the warp band surface.

It is advantageous if the applied thickness measuring arrangement is attached to the sled carrying the warping reed and the following arrangement therefor is common with the warping reed.

BRIEF DESCRIPTION OF THE DRAWINGS

Objects features and advantages of the present invention may be more fully appreciated by reference to the detailed description and to the following drawings, wherein.

DETAILED DESCRIPTION OF THE DRAWINGS

Figure 1:
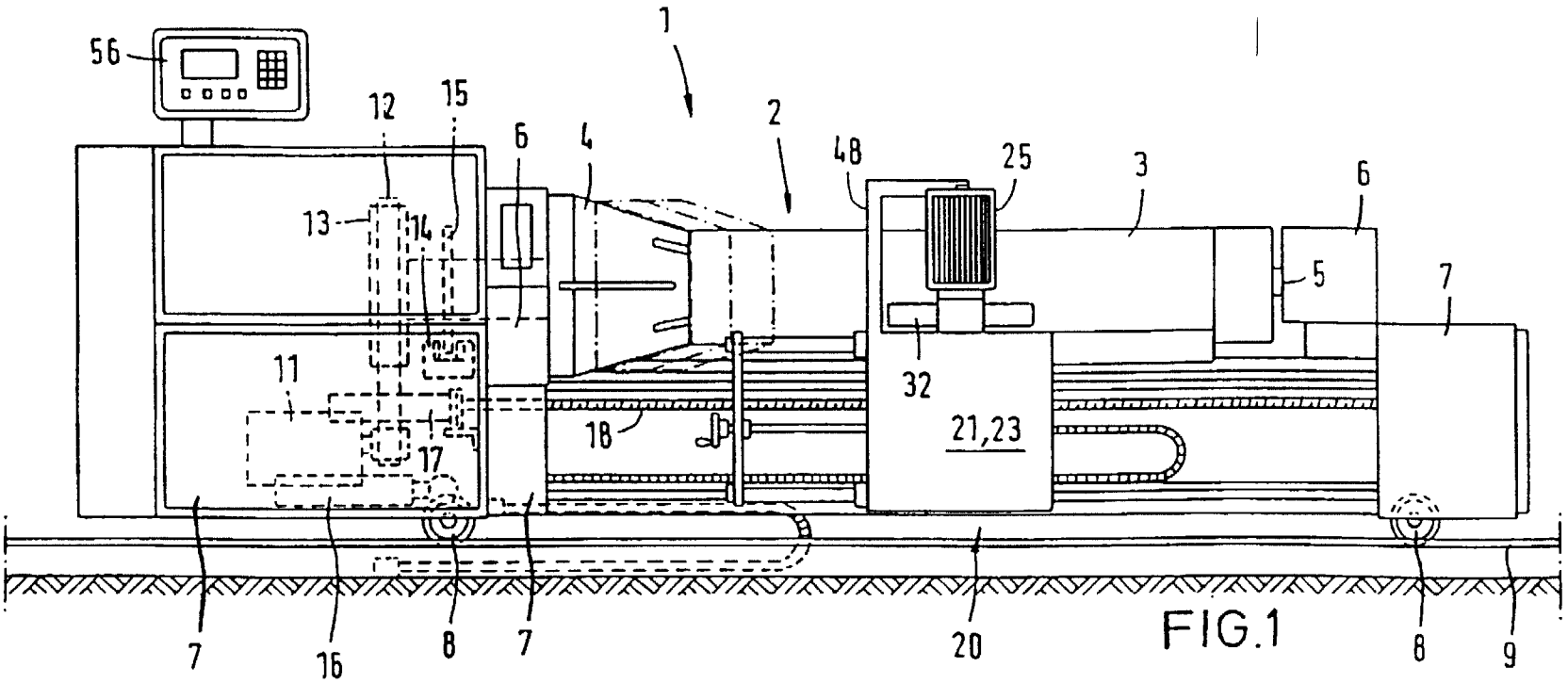
FIG. 1 is a partially schematic and partially cross-sectional, side elevational view of a cone warping machine in accordance with principles of the present invention.

The cone warping machine (1) comprises a warping drum (2) having a cylindrical segment (3) and a conical segment (4). The warping drum (4) is carried in a ground frame (7) in bearings (6). The ground frame (7) is constructed as a carriage and can be moved to and fro on rails (9) by means of running wheels 8.

A motor (11) having a turning impulse generator drives shaft (5) via a translation member (12) and a belt pulley (13) and thereby drives the warping drum (2), wherein there is further provided a brake (14) having a braking disc (15).

There is provided a traction motor (16). A further motor (17) drives a thread led spindle (lead screw 18) by which a support (20) running the length of warp drum (2) may be pushed to and fro by means of spindle nut (19).

The support (20) comprises a warping sled (21), which may be reciprocated along the length of warping drum (2) by means of spindle (18). A further vertically displaceable sled (23) is attached to warping sled (21). This further sled (23) carries the drive mechanism for the movement of a sliding reed (25) transverse to the warping drum. Sled (23) also carries a mechanism for vertically displacing itself and the various items attached thereto; such as arm (48) which holds an applied thickness measuring arrangement (55) orthogonally over the drum axis of the warping drum (5), substantially in the middle, over the just-to-be applied warp band.

A motor (28) drives a shaft (31) via translation members (29) and (30) from which the several drives are led. The sliding reed (25) is located on a cross sled (32). A translation member (33) leads from shaft (31) to a worm drive (34) which drives a thread spindle (35), which can displace the sled (32) in a direction transverse to the longitudinal axis of drum (2).

Sliding reed (25) sits on a spindle (37), which is driven by its own motor (38), which is attached to sled (32). The displacement of reed (25) in the longitudinal direction of drum (5) is thus independent of displacement transverse to the drum axis.

A gear wheel (40) is located on shaft (31) and interacts with a further gear wheel (41), whose shaft (42) is connected with the worm drive (43), which in turn drives spindle (44). The spindle nut (45) is attached to the support sled (21) so that upon activation of spindle (44), the sled (23) is displaced vertically.

Figure 2:
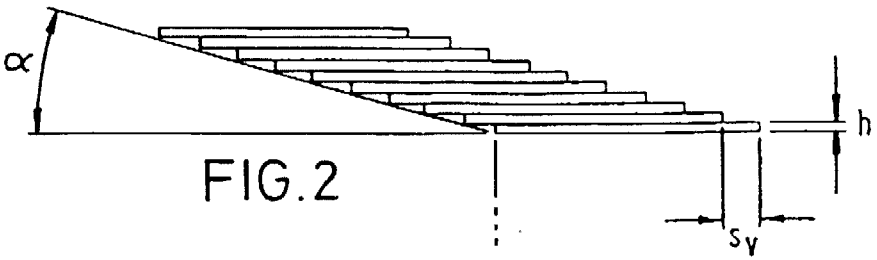
FIG. 2 shows the band layout in the cone warping machine of FIG. 1.
Figure 3:
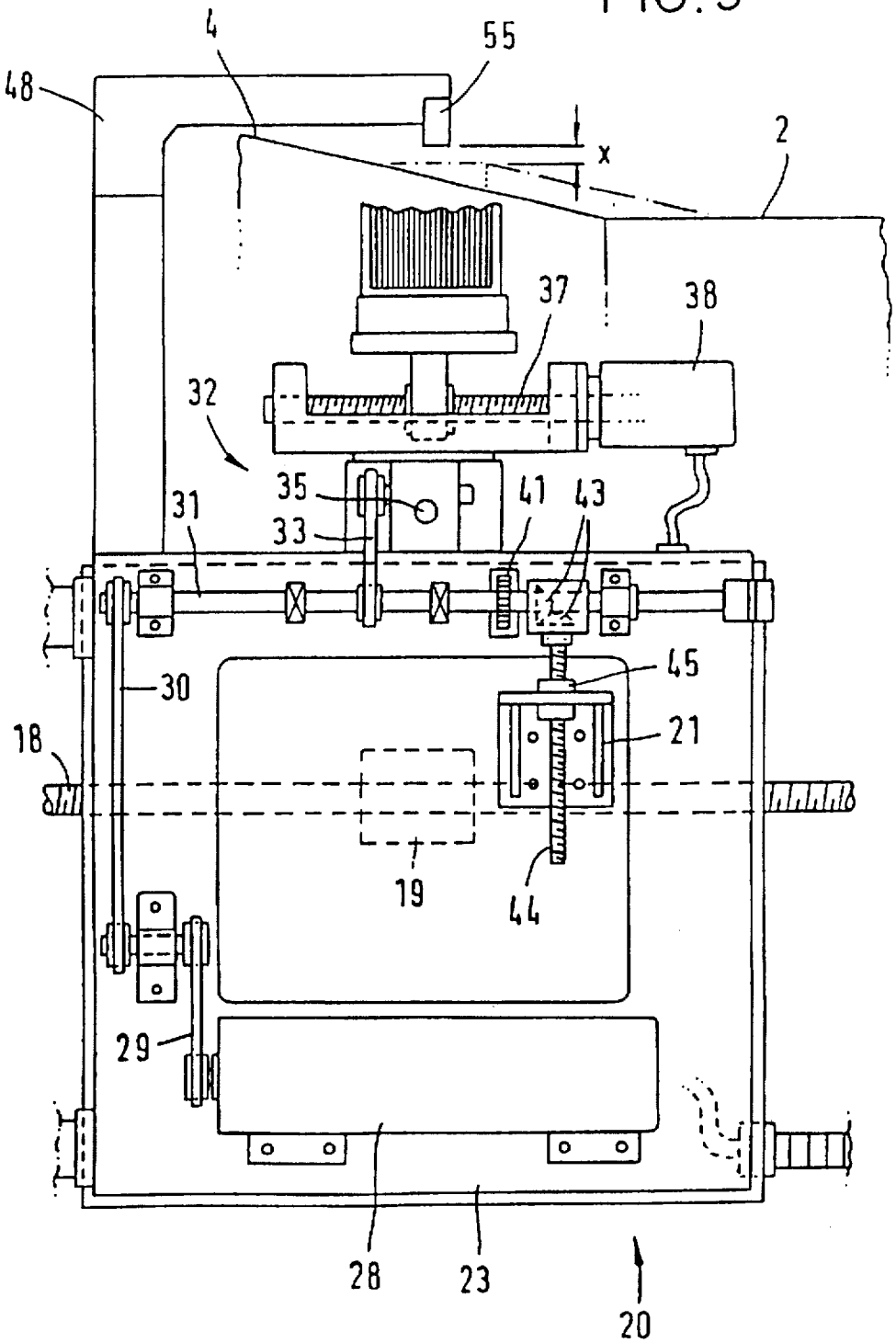
FIG. 3 is a more detailed view of the support of FIG. 1, showing the support carrying the drive mechanism for the vertical displacement of the same, the transverse displacement of the sliding reed, and the displacement of the applied thickness measuring arrangement.
Figure 4:
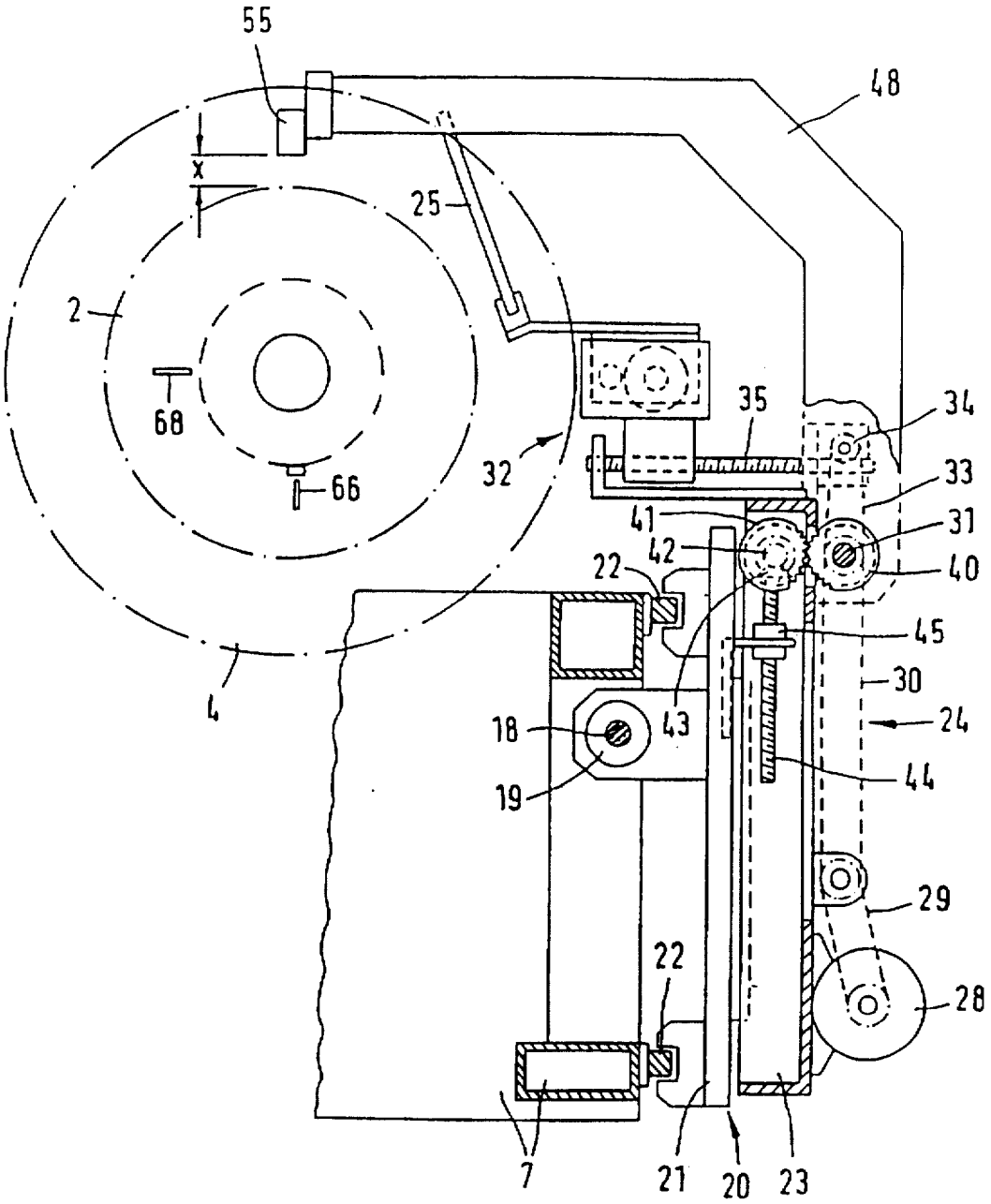
FIG. 4 is a partially cross-sectional, side view of the machine of FIG. 3.
Figure 5:
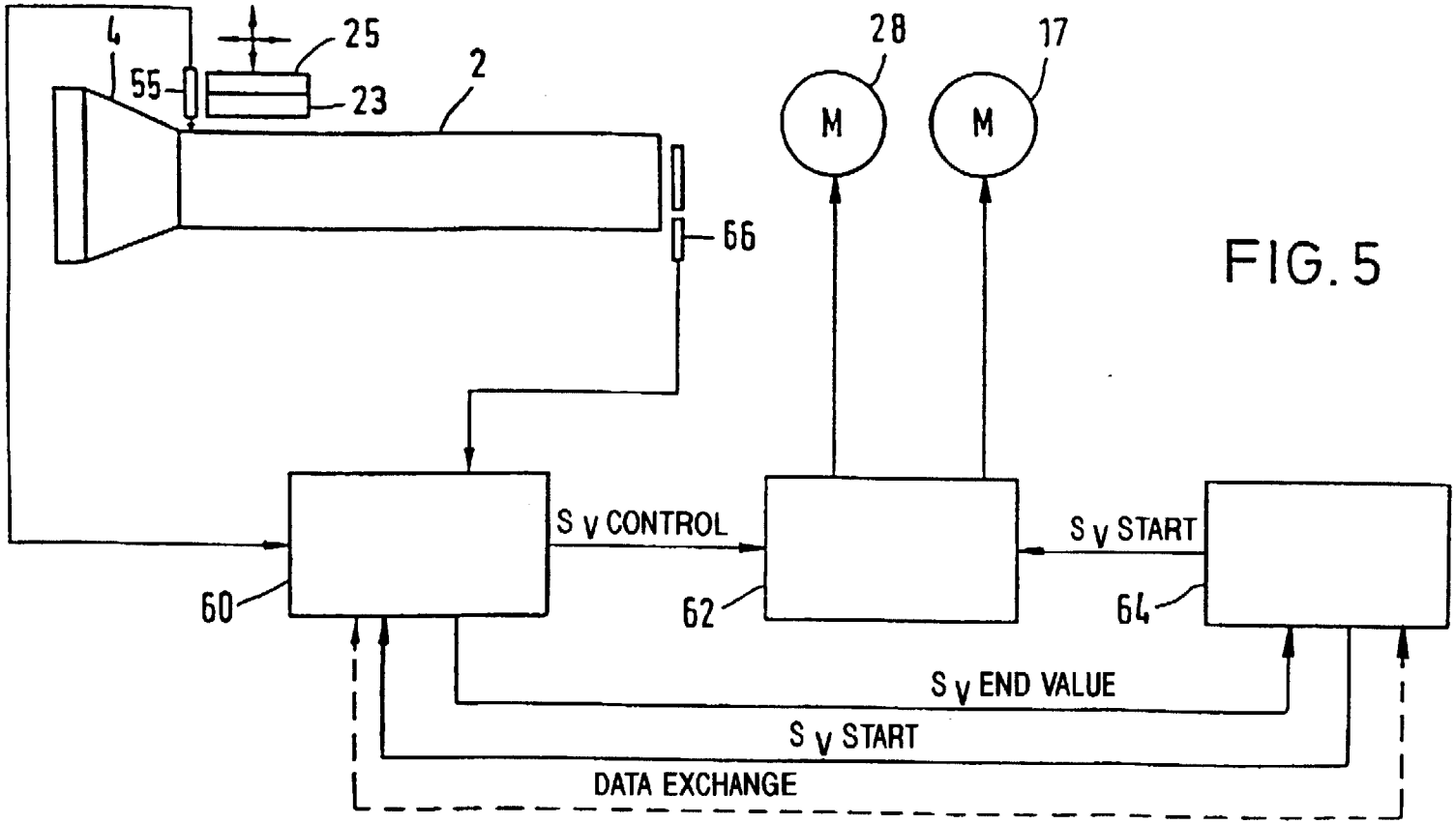
FIG. 5 is a schematic diagram of the control arrangement for the warping machine of FIG. 1.

FIG. 2 shows the structure of the wind in the first warp band on a conical part (4, FIG. 1) having a cone angle (alpha) to the drum axis of 15°.

The increase in height per drum revolution is designated "h" so that the theoretical feed $S_v$ per drum revolution can be expressed as $S_v$ =h/tan(alpha).

The process of warping threads runs substantially automatically, since from the beginning of the warping procedure, without interruption of the winding process, the entire warp can be applied, wherein even the first wind at the beginning may be wound with an optimal feed speed.

In the starting phase the control computer (64) gives a starting signal for the feed speed $S_v$, to a synchronous run control (62), which, for its part, controls drives (17) and (8), that is, the support motor and the motor for the vertical displacement, synchronously with the drum rotation.

The initial value is calculated from the warp parameters, that is, the total number of threads, the warp width and the yarn number in which, for example, the total number of threads is divided by the warp width and the yarn number. The thus provided initial value of the feed speed is only required for the first rotation or rotations. This first provisional feed speed is already a good approximation of the ultimate, yet to be determined feed speed, so that the warping is carried out with an appropriate feed value almost from the first wind layer on.

The learning phase commences no later than the second rotation. With the assistance of the applied thickness measuring arrangement (55), the applied thickness of the warp band is continually and contactlessly measured in the learning phase, in which a separation signal is transmitted to a feed computer (60). At the same time two detecting means (66) and (68) spaced apart from each other around the drum circumference detect the turning motion of the warp drum (2), as well as the direction of motion. These detecting means similarly transmit their signal to the feed computer (60) and cause this to start.

From the second drum revolution the feed computer (60) receives applied thickness measuring signals from which the feed computer (60) can determine corrected feed speeds and transmit a control signal $s_v$-control to the synchronous running control (62), which by means of motors (17) and (28) alter the feed speed and the height of the warping reed (25).

The applied thickness measuring arrangement (55), because it is attached to sled (23) is thus moved with it. The applied thickness measuring arrangement (55) is vertically displaced and in such a manner that it maintains a substantially constant separation distance of about 50 mm from the warp band surface. Thus the laser beam distance measuring arrangement, which is utilized as the applied thickness measuring arrangement (55), is kept in its optimal measuring range. Accordingly, one can measure with great accuracy, the distance of the measuring head to the surface of the warp band and thus, in a contactless manner, the applied thickness. The accuracy of the laser light distance measuring arrangement is about 30 microns. A possible contact with the warping drum (2) can be filtered out and taken into account in the measurement of the applied thickness.

In the learning phase, new measuring values of the applied thickness are taken approximately every 40 milliseconds. At the beginning of the applied thickness measurement it is necessary to limit the correction of the feed speed signal in order to avoid wide control swings. After a predetermined number of drum revolutions the regulated feed speed signal stabilizes, wherein the size variation of sequential signals is substantially reduced. After stabilization of the controlled feed speed signal, that is to say, after 20 to 30 revolutions of the drum, in dependence upon a limiting value for the standard deviation or other limiting value, the learning phase can be completed and the mean value of the last feed speed signals can be designated for the rest of the warping process as a determined, constant, feed speed signal. It is thus certain that an optimal feed speed is automatically determined and maintained in a unitary manner for the entire warping process.

In the working phase therefore, all subsequent warping bands are warped with this ultimate feed speed without further measurement. Relative to the first warping band the subsequent warping bands do not give a different buildup of the wind since the final feed has already been established after a few wind layers.

The ultimate value for the feed speed, determined after the learning phase and at the beginning of the working phase, is retransmitted to the control computer (64) from feed computer (60) so that the control computer (64) can determine the exact wind number in order to maintain the exact predetermined warp length on the service field (56).

Obviously, many modifications and variations of the present invention are possible in light of the above teachings. It is therefore to be understood that within the scope of the appended claims, the invention may be practiced otherwise than as specifically described.

We claim:

1. Process for warping threads into a warp wind on a warping drum of a warping machine with a warping reed and an applied thickness measuring arrangement, comprising the steps of:

setting a preliminary feed speed for the warping reed, synchronized with the number of rotations of the warping drum;

plurally scanning for applied thickness of the warp wind; and setting a corrected feed speed for winding to completion, in dependence upon (I) the number of rotations of the warping drum, and (ii) the applied thickness obtained by the step of plurally scanning, wherein the step of setting the corrected feed speed is performed by:

(a) determining for a starting phase a theoretically correct feed speed as an initial value to be used within at least a first rotation of the warping drum, said theoretically correct feed speed being set in accordance with one or more of a plurality of warp parameters, including total number of threads, warp width, and yarn number;

(b) continually measuring in a contactless manner the applied thickness of a first warp band in a learning phase occurring at least as early as completion of the starting phase, while the applied thickness measuring arrangement is held substantially at a predetermined constant separation from a just applied surface of the warp wind;

(c) determining the applied thickness, in dependence upon signals from the applied thickness measuring arrangement, and controlling the feed speed in response to a control signal, in accordance with the applied thickness, at least as early as the second rotation of the warping drum; and (d) establishing, in a working phase following the learning phase, a constant feed speed that is to be used to completion of the warp wind, after stabilization of recent values of the control signal used for regulating feed speed.

2. Process in accordance with claim 1 wherein the step of plurally scanning includes the step of:

repetitively obtaining measurements in measuring cycles with the applied thickness measuring arrangement, and wherein the step of setting a corrected feed speed is performed by:

limiting the control signal for the feed speed at the beginning of the learning phase, to a predetermined maximum for each of the measuring cycles of the applied thickness measuring arrangement.

3. Process in accordance with claim 2 including the step of:

projecting a laser beam from the applied thickness measuring arrangement to measure separation from the just applied surface of the warp wind.

4. Process in accordance with claim 2 wherein the step of establishing the constant feed speed for the working phase is performed by:

setting the constant feed speed to a mean value based on values of the control signal from a predetermined number of measuring cycles occurring in the learning phase when the control signal remains below a predetermined maximum deviation size during the learning phase.

5. Process in accordance with claim 1 wherein the step of establishing the constant feed speed for the working phase is performed by:

setting the constant feed speed to a mean value based on values of the control signal from a predetermined number of measuring cycles occurring in the learning phase when the control signal remains below a predetermined maximum deviation size during the learning phase.

6. Process in accordance with claim 5 including the step of:

tallying the number of winds, in dependence upon the constant feed speed as developed, for use as an update to ensure the longitudinal extent of warping is kept current.

7. Process according to claim 5 including the step of:

moving the applied thickness measuring arrangement synchronously with (a) rotation of the warping drum, and (b) longitudinal change in a warp band.

8. Process in accordance with claim 2 including the step of:

tallying the number of winds, in dependence upon the constant feed speed as developed, for use as an update to ensure the longitudinal extent of warping is kept current.

9. Process in accordance with claim 1 including the step of:

tallying the number of winds, in dependence upon the constant feed speed as developed, for use as an update to ensure the longitudinal extent of warping is kept current.

10. Process according to claim 1 including the step of:

moving the applied thickness measuring arrangement synchronously with (a) rotation of the warping drum, and (b) longitudinal change in a warp band.

11. Warping machine for transferring a plurality of warp bands, comprising:

a warping drum having a drum axis and adapted to receive the plurality of warp bands;

a warping sled positioned alongside the warping drum and being mounted to allow vertical motion over the warp bands applied on said warping drum;

a warping reed mounted on said warping sled;

an applied thickness measuring arrangement for said warping drum for providing an applied signal signifying applied thickness of the warp bands on said warping drum;

said warping sled further comprising: (a) a vertically adjustable, secondary sled mounted on the warping sled, the applied thickness measuring arrangement being supported by the secondary sled, and (b) a drive mechanism for displacing the warping reed transversely to the drum axis during vertical adjustment of the secondary sled;

a detecting means for providing a revolution number signal signifying revolutions of the warp drum numerically; and control means for providing, in dependence upon the applied signal and the revolution number signal, a feed signal to signify the position of the warping reed, the applied thickness measuring arrangement being mounted to allow motion both parallel and transversely to the warping drum synchronously with (a) revolution of the warp drum, and (b) layer change of the warp band, the applied thickness measuring means being mounted with a range of motion sized to permit it to be maintained at a substantially constant predetermined distance from the warp upper surface, whereby the applied thickness on the warping drum is measured in a contactless manner.

12. Warping machine in accordance with claim 11 wherein the control means in response to the applied signals from the applied thickness measuring arrangement signifying actual separation of the applied thickness measuring arrangement from the warp upper surface, corrects the feed speed signal, the applied thickness measuring including means for automatically responding to the feed speed signal.

13. Warping machine in accordance with claim 12 wherein the applied thickness measuring arrangement comprises a laser beam distance measuring means.

14. Warping machine in accordance with claim 11 wherein the applied thickness measuring arrangement comprises means for scanning measurements automatically at a repetition rate set in dependence upon thread thickness and thread number.

15. Warping machine in accordance with claim 11 wherein the applied thickness measuring arrangement comprises means for scanning measurements automatically at a repetition rate set in dependence upon thread thickness and thread number.

16. Warping machine in accordance with claim 14 wherein the applied thickness measuring arrangement comprises means for repetitively scanning at a period of between 20 and 60 milliseconds.

17. Warping machine in accordance with claim 11 wherein the applied thickness measuring arrangement comprises means for repetitively scanning at a period of between 20 and 60 milliseconds.

18. Warping machine in accordance with claim 11 wherein the applied thickness measuring arrangement comprises means for repetitively scanning at a period of between 10 to 100 milliseconds.

* * * * *